US009573386B2

(12) United States Patent
Motoyanagi

(10) Patent No.: US 9,573,386 B2
(45) Date of Patent: Feb. 21, 2017

(54) OBJECT FORMING METHOD, OBJECT FORMING APPARATUS, AND NONVOLATILE COMPUTER-READABLE RECORDING MEDIUM ON WHICH PROGRAM IS STORED

(71) Applicant: CASIO COMPUTER CO., LTD., Shibuya-ku (JP)

(72) Inventor: Yoshimune Motoyanagi, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/965,498

(22) Filed: Dec. 10, 2015

(65) Prior Publication Data

US 2016/0167397 A1 Jun. 16, 2016

(30) Foreign Application Priority Data

Dec. 11, 2014 (JP) ..... 2014-251258

(51) Int. Cl.
*B41J 3/407* (2006.01)

(52) U.S. Cl.
CPC ..... *B41J 3/4073* (2013.01)

(58) Field of Classification Search
CPC .... B41J 3/407; B29C 67/0074; B29C 67/0092
See application file for complete search history.

(56) References Cited

U.S. PATENT DOCUMENTS 6,965,690 B2 * 11/2005 Matsumoto ..... G06T 17/10 345/420
7,630,537 B2 * 12/2009 Sato ..... A61B 5/0064 250/574
8,199,335 B2 * 6/2012 Mitsumoto ..... G01B 11/245 356/601
8,217,941 B2 * 7/2012 Park ..... G06T 15/205 345/427
2013/0161874 A1 * 6/2013 Horiuchi ..... B29C 44/022 264/415
2013/0280498 A1 * 10/2013 Horiuchi ..... B42C 19/02 428/195.1

FOREIGN PATENT DOCUMENTS

JP 2006-218698 8/2006
JP 2008-299444 12/2008
JP 2012-171317 9/2012
JP 2013-111849 6/2013
JP 2013-136171 7/2013

* cited by examiner

*Primary Examiner* — Anh T. N. Vo
(74) *Attorney, Agent, or Firm* — Cozen O'Connor

(57) ABSTRACT

An object forming method executed by at least one processing unit for forming a three-dimensional shape on a surface of a material, the method including: generating height information specifying a height of the three-dimensional shape, so that the height of the three-dimensional shape in a protection area surrounding a symbol area subjected to symbols on the surface of the material is higher than the height of the three-dimensional shape in the symbol area on the surface of the material, the material is subjected to a design including the symbols on the surface; and forming the three-dimensional shape on the surface of the material based on the generated height information.

24 Claims, 5 Drawing Sheets

OBJECT FORMING METHOD, OBJECT FORMING APPARATUS, AND NONVOLATILE COMPUTER-READABLE RECORDING MEDIUM ON WHICH PROGRAM IS STORED

CROSS-REFERENCE TO RELATED APPLICATION

This application claims the benefit of Japanese Patent Application No. 2014-251258, filed on Dec. 11, 2014, the entire disclosure of which is incorporated by reference herein.

FIELD

This application relates generally to an object forming method, an object forming apparatus, and nonvolatile computer-readable recording medium on which a program is stored.

BACKGROUND

One of known object forming techniques comprises printing a desired pattern with black ink or toner on a heat-expandable sheet that expands and increases in volume when heated, and then uniformly irradiating the entire surface of the heat-expandable sheet with light. This technique takes advantage of the fact that in comparison with the areas where no printing is made, the areas where some printing is made with black ink or toner absorb heat at higher rates and are heated to higher temperatures, and the sheet expands and rises in the areas where some printing is made with black ink or toner. For example, Unexamined Japanese Patent Application Kokai Publication No. 2012-171317 describes an object printing apparatus using the above technique.

On the other hand, a product having a three-dimensional shape formed on a surface of a heat-expandable sheet using the above technique may have the surface erased in part in the course of distribution. For example, if a three-dimensional stamp with an uneven surface is produced using the above technique and the area where numbers and/or characters representing a face value are printed is erased, information regarding the stamp face value is missing and the stamp face value becomes unknown.

SUMMARY

The object forming method according to the present disclosure is an object forming method executed by at least one processing unit for forming a three-dimensional shape on a surface of a material, the method comprising:

generating height information specifying a height of the three-dimensional shape, so that the height of the three-dimensional shape in a protection area surrounding a symbol area subjected to symbols on the surface of the material is higher than the height of the three-dimensional shape in the symbol area on the surface of the material, the material is subjected to a design including the symbols on the surface; and forming the three-dimensional shape on the surface of the material based on the generated height information.

The object forming apparatus according to the present disclosure is an object forming apparatus forming a three-dimensional shape on a surface of a material, the apparatus comprising at least one processing unit which function as follows:

a height information generation unit generating height information specifying a height of the three-dimensional shape, so that the height of the three-dimensional shape in a protection area surrounding a symbol area subjected to symbols on the surface of the material is higher than the height of the three-dimensional shape in the symbol area on the surface of the material, the material is subjected to a design including the symbols on the surface; and a three-dimensional shape forming unit forming the three-dimensional shape on the surface of the material based on the generated height information.

The non-transitory recording medium according to the present disclosure is a nonvolatile computer-readable recording medium on which a program allowing a computer of an object forming apparatus forming a three-dimensional shape on a surface of a material to function as follows is stored:

the material is subjected to a design including symbols on the surface, and a height information generation unit generating height information specifying a height of the three-dimensional shape, so that the height of the three-dimensional shape in a protection area surrounding a symbol area subjected to the symbols on the surface of the material is higher than the height of the three-dimensional shape in the symbol area on the surface of the material; and a three-dimensional shape forming unit forming the three-dimensional shape on the surface of the material based on the generated height information.

BRIEF DESCRIPTION OF THE DRAWINGS

A more complete understanding of this application can be obtained when the following detailed description is considered in conjunction with the following drawings, in which.

DETAILED DESCRIPTION

Figure 1:
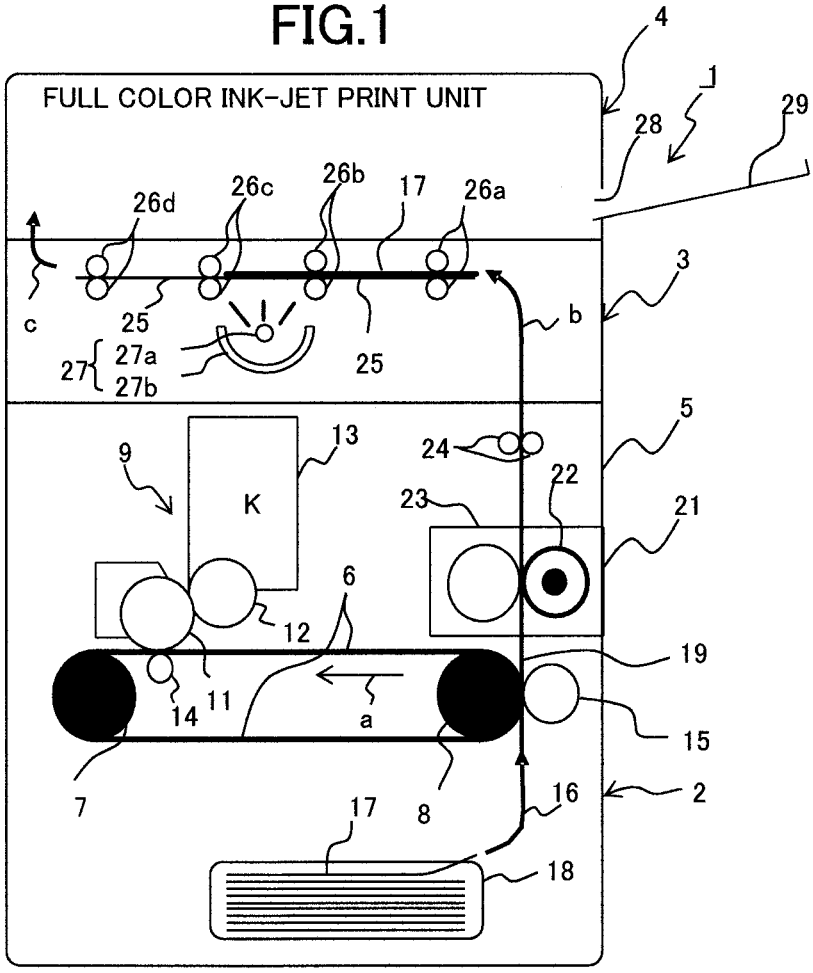
FIG. 1 is a diagram showing an exemplary configuration of an object forming apparatus according to an embodiment of the present disclosure.

FIG. 1 is a diagram showing an exemplary configuration of an object forming apparatus 1 according to an embodiment of the present disclosure. The object forming apparatus 1 shown in FIG. 1 is an apparatus forming a three-dimensional shape according to height information that is a numerical value specifying the height on a surface of a base material subjected to a design including symbols, and comprises a black toner printing unit 2 disposed in the lowermost part, a heat expansion process unit 3 disposed above the black toner printing unit 2, and an inkjet print unit 4 disposed in the uppermost part.

The "three-dimensional shape" hereinafter does not necessarily refer to a shape of an object which has sizes in proportion to a three-dimensional size of a real object. In other words, a height of the "three-dimensional shape" does not necessarily fit to the other two-dimensional size of the real object. The "height" hereinafter refers to the length of the three-dimensional shape along a vertical line of the surface of the base material.

The black toner printing unit 2 comprises an endless transfer belt 6 extending horizontally within an apparatus housing 5 in the center. The transfer belt 6 is disposed in tension by a not-shown tension mechanism and placed around a drive roller 7 and a driven roller 8. Driven by the drive roller 7, the transfer belt 6 circulates counterclockwise as indicated by an arrow a in the figure.

A photo conductor drum 11 of an image forming unit 9 is so disposed as to be in contact with the upper circulating surface of the transfer belt 6. A not-shown cleaner, initialization charger, and optical writing head, and subsequently an image development roller 12 and the like are closely disposed around the peripheral surface of the photo conductor drum 11.

The image development roller 12 is disposed at the side opening of a toner container 13. The toner container 13 contains black toner K. The black toner K consists of a nonmagnetic monocomponent toner.

The image development roller 12 carries on its surface a thin layer of black toner K contained in the toner container 13 and develops an electrostatic latent image formed on the peripheral surface of the photo conductor drum 11 with the black toner K by means of the optical writing head.

A first transfer roller 14 is pressed against the lower part of the photo conductor drum 11 via the transfer belt 6 so as to constitute a first transfer unit. The first transfer roller 14 is supplied with a bias voltage from a not-shown bias supply.

The first transfer roller 14 applies the bias voltage supplied from the bias supply to the transfer belt 6 to transfer an image developed with the black toner K on the peripheral surface of the photo conductor drum 11 to the transfer belt 6.

A second transfer roller 15 is pressed against the driven roller 8 around which the right end of the transfer belt 6 shown in FIG. 1 runs via the transfer belt 6 so as to constitute a second transfer unit. The second transfer roller 15 is supplied with a bias voltage from a not-shown bias supply.

The second transfer roller 15 applies the bias voltage supplied from the bias supply to the transfer belt 6 to transfer the image of black toner K first-transferred to the transfer belt 6 to a recording medium 17 conveyed along an image formation conveyance path 16 from below in FIG. 1 as shown by an arrow.

Figure 2A:
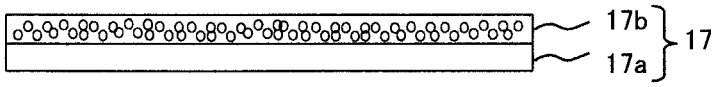
FIGS. 2A and 2B are illustrations showing the structure of a heat-expandable sheet.
Figure 2B:
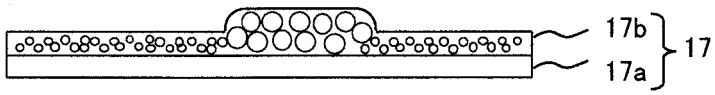

Here, a heat-expandable sheet is used as the recording medium 17 (also termed a printing medium) in this embodiment. A heat-expandable sheet comprises, as shown in FIGS. 2A and 2B, a base material 17*a* and a expand layer 17*b* coating the base material 17*a*. The base material 17*a* consists of paper, fabric such as canvas, a panel material such as plastic, or the like and is not particularly restricted in its nature. The expand layer 17*b* is a layer characteristically expanding and increasing in volume, and consists of a resin containing heat-expandable microcapsules. FIG. 2A shows a heat-expandable sheet of which the expand layer 17*b* has not expanded and FIG. 2B shows a heat-expandable sheet of which the expand layer 17*b* has expanded in part.

The recording medium 17 is loaded and housed in a recording medium container 18 comprising a paper feed cassette or the like. The uppermost one sheet of the recording medium 17 is retrieved by a not-shown paper feed roller or the like and sent out to the image formation conveyance path 16. Subsequently, the recording medium 17 is conveyed on the image formation conveyance path 16 and has an image of black toner K transferred while passing through the above-mentioned second transfer unit.

The recording medium 17 having an image of black toner K transferred is conveyed to a fuse unit 21 along a fusing conveyance path 19. A heat roller 22 and pressure roller 23 of the fuse unit 21 clamp and convey the recording medium 17 while applying heat and a pressure.

As a result, the second-transferred image of black toner K is fused on the paper surface of the recording medium 17. Subsequently, the recording medium 17 is further conveyed by the heat roller 22 and pressure roller 23 and ejected into the heat expansion process unit 3 above the black toner printing unit 2 by a pair of fuse unit ejection rollers 24. Here, the recording medium 17 (heat-expandable sheet) is conveyed in the fuse unit 21 at a relatively high speed. Therefore, the part of the heat-expandable sheet where an image of black toner K is printed (the black toner print part, hereafter) does not expand under heat from the heat roller 22.

A medium conveyance path 25 is formed in the upper part of the heat expansion process unit 3 and four pairs of conveyance rollers 26 (26*a*, 26*b*, 26*c*, and 26*d*) are disposed along the medium conveyance path 25. Then, a heat ray emission unit 27 is disposed below the medium conveyance path 25 almost in the center.

The heat ray emission unit 27 comprises a halogen lamp 27*a* and a reflecting mirror 27*b* nearly semicircular in cross-section to surround the lower half of the halogen lamp 27*a*.

In this embodiment, the halogen lamp 27*a* is a 900 W halogen lamp and disposed 4 cm away from the surface of the recording medium 17 conveyed along the medium conveyance path 25. The pairs of conveyance rollers 26 convey the recording medium 17 at a conveyance speed of 20 mm/second. Under this condition, the recording medium 17 is heated to 100° C. to 110° C. and the black toner print part of the recording medium 17 is subject to heat expansion.

Although the recoding medium 17 is conveyed in the black toner printing unit 2 at a higher conveyance speed and in the heat expansion process unit 3 at a lower conveyance speed, the recording medium 17 is conveyed from the recording medium container 18 one sheet at a time and not successively conveyed before completely conveyed through the heat expansion process unit 3.

Therefore, the recording medium 17 conveyed to the heat expansion process unit 3 is retained only for a short time in a bent state on a conveyance path b between the pair of fuse unit ejection rollers 24 in the black toner printing unit 2 and the first pair of conveyance rollers 26*a* in the heat expansion process unit 3, whereby no inconvenience occurs to the conveyance as a whole.

The pairs of conveyance rollers 26 may be constructed by pairs of elongated rollers extending in the width direction of the recording medium 17 orthogonal to the conveyance direction, or by pairs of short rollers clamping only at either end and conveying the recording medium 17.

The recording medium 17 of which the black toner print part is thermally expanded and made three-dimensional in the heat expansion process unit 3 is conveyed to an inkjet print unit 4 along a conveyance path c.

Here, the above-described pairs of conveyance rollers 26 may be constructed by pairs of elongated rollers extending in the width direction of the recording medium 17 orthogonal to the conveyance direction, or by pairs of short rollers clamping only at both end and conveying the recording medium 17.

Figure 3:
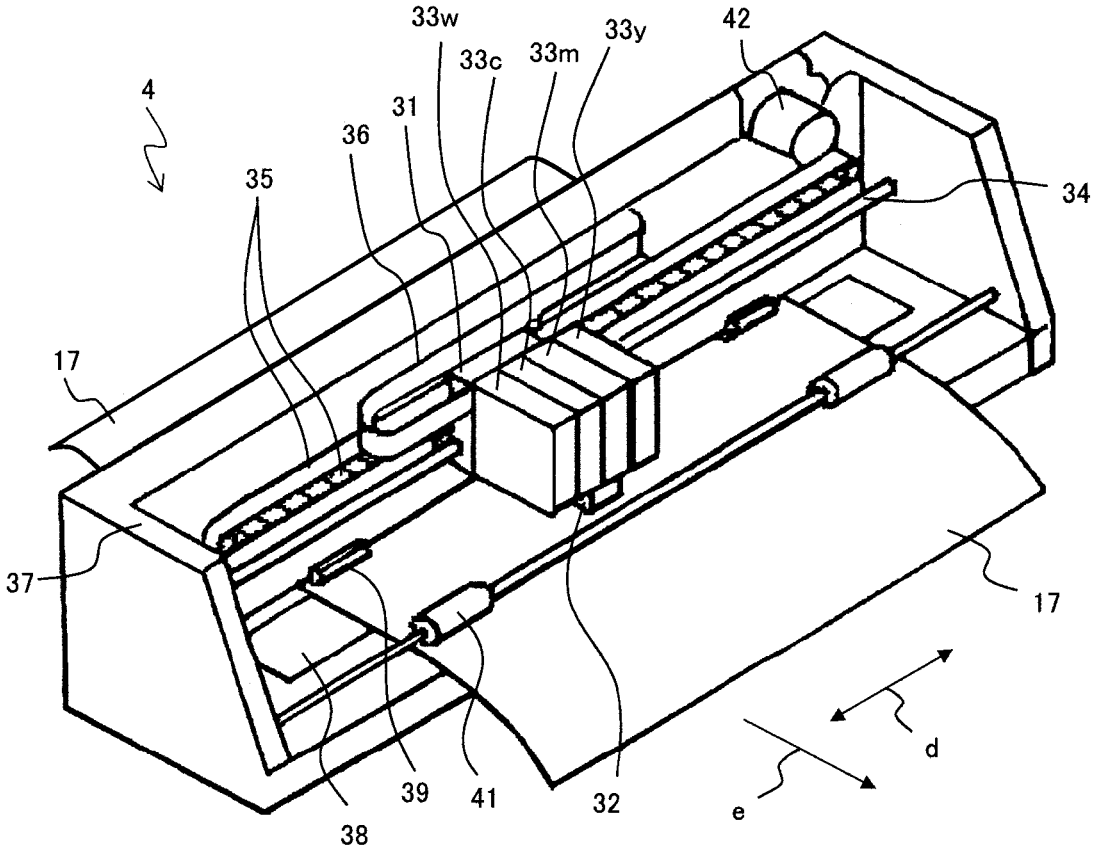
FIG. 3 is a perspective view showing the configuration of the inkjet print unit.

FIG. 3 is a perspective view showing the configuration of the inkjet print unit 4. In the inkjet print unit 4 shown in FIG. 3, an inner frame 37 shown in FIG. 3 is disposed between the conveyance path c and a medium ejection outlet 28 comprising a paper ejection tray 29 outside as shown in FIG. 1.

The inkjet print unit 4 comprises a carriage 31 so disposed as to be able to reciprocate in the direction indicated by a two-headed arrow d orthogonal to the medium conveyance direction. A print head 32 executing printing and ink cartridges 33 (33*w*, 33*c*, 33*m*, and 33*y*) containing ink are attached to the carriage 31.

The cartridges 33*w*, 33*c*, 33*m*, and 33*y* contain white W, cyan C, magenta M, and yellow Y ink, respectively. These cartridges are individual cartridges or ink compartments consolidated into one casing, and coupled to the print head 32 having nozzles each ejecting a color ink.

Moreover, the carriage 31 is slidably supported by a guide rail 34 on one end and fixed to a toothed drive belt 35 on the other end. As a result, the print head 32 and ink cartridges 33 (33*w*, 33*c*, 33*m*, and 33*y*) reciprocate together with the carriage 31 in the direction orthogonal to the medium conveyance direction, namely the main scan direction of printing, indicated by the two-headed arrow d in FIG. 3.

A flexible communication cable 36 is connected between the print head 32 and a control device (computer) described later of the object forming apparatus 1 via the inner frame 37. Print data and control signals are sent to the print head 32 from the control device via the flexible communication cable 36.

Facing the print head 32 and extending in the main scan direction of the print head 32, a platen 38 constituting a part of the medium conveyance path is disposed at the lower end of the inner frame 37.

Making contact with the platen 38, the recording medium 17 is intermittently conveyed in the sub-scan direction of printing indicated by an arrow e in FIG. 3 by pairs of feed rollers 39 (the lower rollers are hidden by the recording medium 17) and pairs of paper ejection rollers 41 (the lower rollers are similarly hidden by the recording medium 17).

During intermissions of the intermittent conveyance of the recording medium 17, driven by a motor 42 via the toothed drive belt 35 and carriage 31, the print head 32 ejects drops of ink on the recording medium 17 at close range for printing on the paper surface. The above-described intermittent conveyance of the recording medium 17 and printing by the reciprocating print head 32 are repeated for printing (making print) on the entire surface of the recording medium 17.

Figure 4:
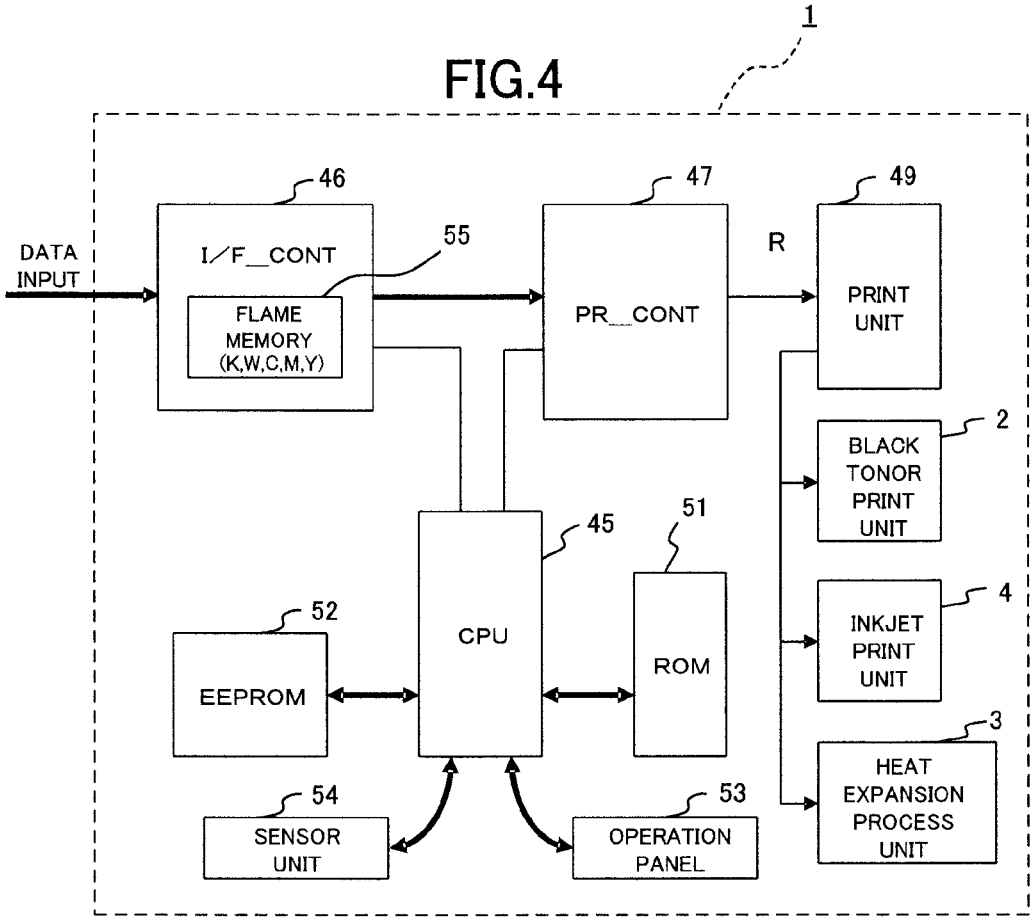
FIG. 4 is a circuit block diagram including the control device of the object forming apparatus.

FIG. 4 is a circuit block diagram including the control device of the object forming apparatus 1. Here, the control device of the object forming apparatus 1 is a computer of the object forming apparatus 1 and a height information generation unit generating second height information described later. As shown in FIG. 4, the circuit block includes a central processing unit (CPU) 45 as the core and an interface controller ($I/F_{13}CONT$) 46 and a printer controller ($PR_{13}CONT$) 47 are each connected to the CPU 45 via a data bus. A print unit 49 is connected to the above PR_CONT 47.

Moreover, a read only memory (ROM) 51, an electrically erasable programmable ROM (EEPROM) 52, a main body operation unit operation panel 53, and a sensor unit 54 receiving outputs from sensors disposed at units are connected to the CPU 45. The ROM 51 stores system programs. The operation panel 53 comprises a touch type display screen.

The CPU 45 reads the system programs stored in the ROM 51 and controls the units according to the read system programs for processing.

In other words, at each unit, first, the I/F_CONT 46 converts print data supplied from, for example, a host device such as a personal computer to bitmap data and loads the bitmap data on a frame memory 55.

Storage areas corresponding to print data for black toner K and print data for each color ink, white W, cyan C, magenta M, and yellow Y, are set up in the frame memory 55. The print data for each color image are loaded in the storage area. The loaded data are output to the PR_CONT 47 and output from the PR_CONT 47 to the print unit 49.

The print unit 49 is an engine unit, and controls the voltages applied to the rotation drive system including the photo conductor drum 11, first transfer roller 14, and the like of the black toner printing unit 2 shown in FIG. 1, the initialization charger not shown in FIG. 1, and the image forming unit 9 having driven units such as an optical writing head, and the driving power to process loads such as driving of the transfer belt 6 and fuse unit 21 under the control of the PR_CONT 47.

The print unit 49 further controls driving of the four pairs of conveyance rollers 26 of the heat expansion process unit 3 and driving of light emission of the heat ray emission unit 27 shown in FIG. 1, and their timing. The print unit 49 further controls operation of the units of the inkjet print unit 4 shown in FIGS. 1 and 3.

Then, the black toner K image data output from the PR_CONT 47 are supplied from the print unit 49 to a not-shown optical writing head of the image forming unit 9 in the black toner printing unit 2 shown in FIG. 1.

Moreover, the white W, cyan C, magenta M, and yellow Y image data output from the PR_CONT 47 are each supplied to the print head 32 shown in FIG. 3.

Here, the above-described black toner K print data correspond to height information specifying the height of a three-dimensional shape formed in the heat expansion process unit 3. In the control device shown in FIG. 4, new black toner K print data (second height information) are generated from the black toner K print data supplied from the host device (first height information) and output to the PR_CONT 47.

Figure 5:
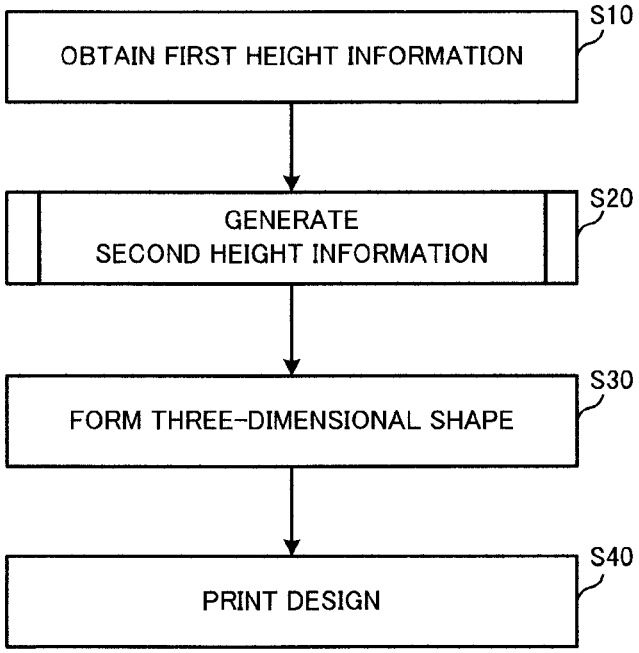
FIG. 5 is a flowchart showing the process flow of the object forming procedure executed in the object forming apparatus.
Figure 6:
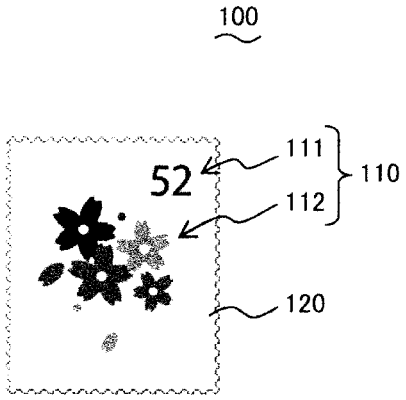
FIG. 6 is an illustration showing an exemplary design of a stamp printed by the inkjet print unit of the object forming apparatus.
Figure 7:
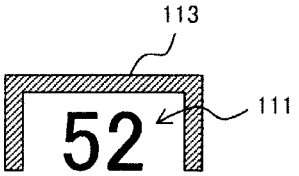
FIG. 7 is an illustration showing an exemplary layout of the protection area.
Figure 8:
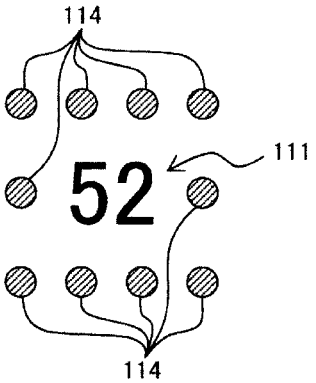
FIG. 8 is an illustration showing another exemplary layout of the protection area.
Figure 9:
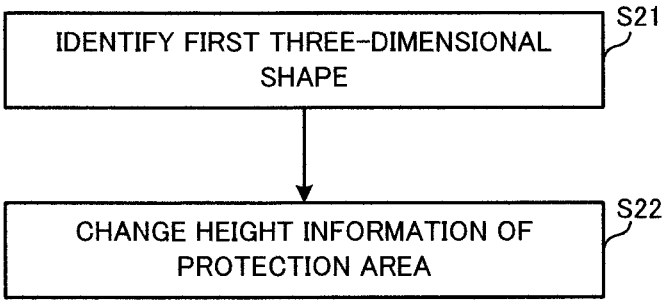
FIG. 9 is a flowchart showing the process flow of the second height information generation procedure shown in FIG. 5.
Figure 10:
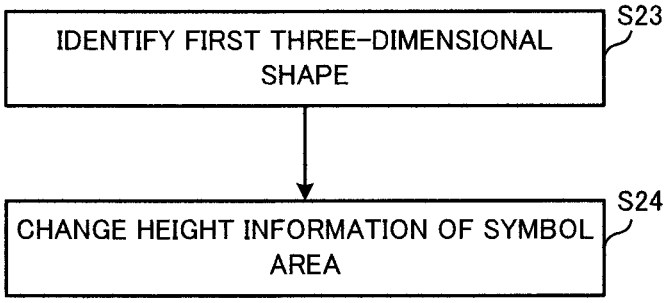
FIG. 10 a flowchart showing the process flow of a modified example of the second height information generation procedure shown in FIG. 5.

FIG. 5 is a flowchart showing the process flow of the object forming procedure executed in the object forming apparatus 1. FIG. 6 is an illustration showing an exemplary design of a stamp printed by the inkjet print unit 4 of the object forming apparatus 1. FIG. 7 is an illustration showing an exemplary layout of the protection area. FIG. 8 is an illustration showing another exemplary layout of the protection area. FIG. 9 is a flowchart showing the process flow of the second height information generation procedure shown in FIG. 5. FIG. 10 a flowchart showing the process flow of a modified example of the second height information generation procedure shown in FIG. 5.

The object forming procedure executed in the above-described object forming apparatus 1 to form a three-dimensional shape protecting a given area will specifically be described below using a case of producing a three-dimensional stamp with reference to FIGS. 5 to 10.

First, the object forming apparatus 1 obtains first height information (Step S10). The first height information is supplied from, for example, a host device such as a personal computer to the I/F_CONT 46 and stored in the frame memory 55.

The first height information is height information determined based on a design of a stamp 100 shown in FIG. 6 and specifies the height of a first three-dimensional shape. The first height information includes height information of an area subjected to the design (a design area 110) and height information of an edge area situated outside the design area and not subjected to the design (an edge area 120).

The height information of the area subjected to the design (the design area 110) further includes height information of an area subjected to symbols included in the design (a symbol area 111) and height information of the area of the design area 110 excluding the symbol area 111 (an outside-symbol area 112). Here, the symbols included in the design mean characters or numbers (for example, 52) representing the face value of the stamp 100 in FIG. 6.

In this embodiment, the design area 110, symbol area 111, outside-symbol area 112, and edge area 120 of the first three-dimensional shape have heights of 0 mm to Y mm, 0 mm to X mm, 0 mm to Y mm, and 0 mm, respectively. Here, X is less than Y, namely X<Y.

Then, the control device of the object forming apparatus 1 generates second height information from the first height information (Step S20). The second height information generated by the control device of the object forming apparatus 1 is stored in the frame memory 55.

The second height information is height information so determined as to protect the three-dimensional shape of the symbol area 111 and specifies the height of a second three-dimensional shape. The second three-dimensional shape is a three-dimensional shape formed in a protection area for protecting the three-dimensional shape of the symbol area 111 and having a higher height in the protection area than in the symbol area 111.

The protection area has only to be an area surrounding the symbol area 111 and more specifically, may be the entire area or a partial area of the edge area 120 and outside-symbol area 112 or an area extending from one of the edge area 120 and outside-symbol area 112 to the other. Moreover, it is desirable that the protection area is an area completely surrounding the symbol area 111 such as the entire edge area 120. However, the protection area may be an area surrounding the symbol area drum 111 at least in part as shown in FIGS. 7 and 8 (areas 113 and 114). FIG. 7 shows an exemplary protection area (the area 113) formed on three sides of the symbol area 111. FIG. 8 shows multiple protection areas (the areas 114) discretely distributed around the symbol area 111 by way of example.

The second height information may be generated by changing the height information of the protection area in the first height information. In such a case, first, the first height information is identified (Step S21), and then the height information of the protection area is changed so that the height of the protection area is higher than the largest height of the symbol area 111 (Step S22). As a result, the second height information is generated from the first height information.

More specifically, for example, in the Step S21, the largest height of the symbol area 111 is identified from the height information of the symbol area 111 in the first height information. Then, in the Step S22, the height information of the edge area 120 in the first height information is changed to height information representing a height exceeding the largest height of the symbol area 111. As a result, the second height information allowing the edge area 120 to serve as the protection area can be generated. Here, the heights of the symbol area 111 and edge area 120 of the second three-dimensional shape are 0 mm to X mm and X+α mm (α>0), respectively. Therefore, the following relationship is established: the height of the edge area 120 is higher than the height of the symbol area 111. Moreover, in doing so, the area of the edge area 120 of which the height information is changed may be the entire edge area 120 or an area of the edge area 120 that surrounds the symbol area 111 at least in part.

In such a case, the height information of the design area 110 in the second height information is the same as that contained in the first height information. Therefore, it is possible to reproduce in the design area 110 a three-dimensional shape determined based on the design in Step S30 described later.

Moreover, as another method, for example, in the Step S21, the largest height of the symbol area 111 and height of the outside-symbol area 112 are identified from the height information of the symbol area 111 and the height information of the outside-symbol area 112 in the first height information. Then, in the Step S22, the height information of the outside-symbol area 112 in the first height information is changed to height information representing a height that is the sum of the height of the outside-symbol area 112 and a height exceeding the largest height of the symbol area 111. As a result, the second height information allowing the outside-symbol area 112 to serve as the protection area can be generated. Moreover, the heights of the symbol area 111 and outside-symbol area 112 of the second three-dimensional shape are 0 mm to X mm and X+α mm to Y+X+α mm, respectively. Therefore, the following relationship is established: the height of the outside-symbol area 112 is higher than the height of the symbol area 111. Moreover, in doing so, the area of the outside-symbol area 112 of which the height information is changed may be the entire outside-symbol area 112 or an area of the outside-symbol area 112 that surrounds the symbol area 111 at least in part.

In such a case, as a result of Step S30 described later, the area adjoining to the symbol area 111 (the symbol adjoining area, hereafter) is higher than the symbol area 111, whereby the symbol area 111 can more realizably be protected.

Moreover, when a three-dimensional shape is formed based on the height information generated in the above-described procedure, namely the second height information allowing the outside-symbol area 112 to serve as the protection area, the height of the outside-symbol area 112 may exceed the height of a three-dimensional shape a heat-expandable sheet is capable of forming (the critical height, hereafter) in some cases.

In such a case, in the Step S22, first, a numerical value that is the height information of the outside-symbol area 112 in the first height information is multiplied by a certain coefficient less than 1. Then, the numerical value representing the height information of the outside-symbol area 112 in the first height information is changed to a numerical value that is the sum of the numerical value multiplied by the coefficient and a numerical value that is information representing a height exceeding the largest height of the symbol area 111.

With the above method, the height of the outside-symbol area 112 can be kept within the critical height by adjusting the reduction ratio, whereby the symbol area 111 can more reliably be protected while maintaining the high-low relationship within the outside-symbol area 112.

Moreover, the method of generating the second height information is not limited to the above-described. The second height information may be generated by changing the height information of the symbol area 111 in the first height information as shown in FIG. 10. In such a case, first, the first height information is identified (Step S23), and then the height information of the symbol area 111 is changed so that the height of the protection area is higher than the height (desirably, the largest height) of the symbol area 111 (Step S24). As a result, the second height information is generated from the first height information.

More specifically, for example, in the Step S23, the largest height of the symbol area 111 and the smallest height of the symbol adjoining area in the outside-symbol area 112 are identified from the height information of the symbol area 111 and the height information of the outside-symbol area 112 in the first height information. Then, in the Step S24, the height information of the symbol area 111 in the first height information is changed to height information representing a height smaller than the smallest height of the symbol adjoining area. As a result, the second height information allowing the outside-symbol area 112 (particularly, the symbol adjoining area) to serve as the protection area can be generated. Moreover, in doing so, the area of the outside-symbol area 112 of which the height information is changed may be the entire outside-symbol area 112 or an area of the outside-symbol area 112 that surrounds the symbol area 111 at least in part. Furthermore, the area of which the height information is changed may be at least one of the outside-symbol area 112 and edge area 120, or the entire outside-symbol area 112 and edge area 120, or an area of the outside-symbol area 112 and edge area 120 that surrounds the symbol area 111 at least in part.

In such a case, the height information of the outside-symbol area 112 in the second height information is the same as that contained in the first height information. Therefore, it is possible to reproduce in the outside-symbol area 112 a three-dimensional shape determined based on the design in Step S30 described later. Furthermore, the symbol adjoining area is higher than the symbol area 111, whereby the symbol area 111 can more reliably be protected.

As the second height information is generated as described above, the object forming apparatus 1 forms a three-dimensional shape on a surface of a heat-expandable sheet (Step S30). In the Step S30, first, the black toner printing unit 2 makes print on a surface of a heat-expandable sheet with black toner. The print density is determined based on the second height information generated in the Step S20 and higher density print is made where the area is higher. The print density is adjusted by, for example, area gradation.

Subsequently, the heat expansion process unit 3 heats the heat-expandable sheet for the heat-expandable sheet to expand, whereby the surface of the heat-expandable sheet rises to heights corresponding to the print density. As a result, the heat-expandable sheet expands and forms a second three-dimensional shape based on the second height information. In other words, in the object forming apparatus 1, the black toner printing unit 2 and heat expansion process unit 3 constitute a three-dimensional shape forming unit forming a second three-dimensional shape on a surface of a heat-expandable sheet based on the second height information.

Lastly, the object forming apparatus 1 prints the design on the second three-dimensional shape formed on the surface of the heat-expandable sheet by means of the inkjet print unit 4 (Step S40).

As the object forming apparatus 1 executes the procedure shown in FIG. 5, a three-dimensional shape properly protecting an area in which symbols such as numbers and characters included in a design are printed can be formed on a surface of a material such as a heat-expandable sheet. Therefore, even when a three-dimensional stamp is produced using a heat-expandable sheet, it is possible to prevent the part in which numbers and/or characters representing a face value from being erased and information regarding the stamp face value from becoming missing, whereby the incident of the stamp face value becoming unknown can be prevented.

The above-described exemplary embodiments are given as specific exemplary embodiments for easier understanding of the present disclosure and the present disclosure is not restricted to these exemplary embodiments. The object forming method, object forming apparatus, and program can be modified and/or changed in a variety of ways to the extent of not departing from the idea of the present disclosure set forth in the scope of claims. Some of the characteristics in the context of individual exemplary embodiments described herein may be combined into a single exemplary embodiment.

For example, in FIGS. 9 and 10, the height information of the symbol area 111 or protection area is changed to generate the second height information by way of example. However, the height information of both the symbol area 111 and protection area may be changed to generate the second height information. Moreover, a stamp is produced using a heat-expandable sheet by way of example. However, for example, revenue stamps or postcards may be produced as long as they are subjected to a design including symbols.

Moreover, in the above-described embodiment, the object forming apparatus 1 heats a heat-expandable sheet to raise its surface and then print a design. However, this is not restrictive. It is possible to print a design before raising the surface of the heat-expandable sheet. In doing so, for example, if the hue of the design printed before raising the surface fades because of the raised surface, it is possible to print a design in a darker hue before raising the surface so as to obtain a desired hue after raising the surface.

Several embodiments of the present disclosure are described above. The scope of the present disclosure is not restricted to the above-described embodiments and includes the scope of the disclosure set forth in the scope of claims and the scope equivalent thereto.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An object forming method executed by a processor-controlled apparatus, having at least one processing unit for forming a three-dimensional object on a surface of a material, the method comprising:

obtaining height information specifying a height of the three-dimensional object on the surface of the material, wherein the three-dimensional object has (i) a design area that includes printed symbols in a symbol area, and (ii) a non-symbol protection area surrounding the symbols; and forming the three-dimensional object based on said obtained height information, wherein the height of the three-dimensional object in said protection area is higher than in said symbol area.

2. The object forming method according to claim 1, further comprising:

obtaining first height information, based on a design selected for said three-dimensional object, specifying height of the printed symbols;

generating, based on the first height information, second height information specifying the height of the three-dimensional object in the protection area that is higher than the height of the three-dimensional object in the symbol area, and forming the three-dimensional object on the surface of the material based on the generated second height information.

3. The object forming method according to claim 2, wherein the obtained first information includes height information of the protection area; and the generating of the second height information from the first height information comprises increasing the height information of the protection area in the first height information.

4. The object forming method according to claim 2, wherein the generating of the second height information from the first height information comprises decreasing the height information of the symbol area in the first height information.

5. The object forming method according to claim 3, wherein the protection area is an area not subjected to the design and surrounds an area subjected to the design.

6. The object forming method according to claim 3, wherein the protection area is an area other than the symbol area.

7. The object forming method according to claim 4, wherein the protection area is an area other than the symbol area.

8. The object forming method according to claim 2, wherein the material is a heat-expandable sheet, and the forming of the three-dimensional object comprises expanding the heat-expandable sheet based on the second height information.

9. The object forming method according to claim 2, wherein the symbols are numbers or characters representing a face value of a stamp.

10. The object forming method according to claim 1, wherein the step of obtaining the height information of the three-dimensional object comprises generating said height information.

11. A processor-controlled object forming apparatus for forming a three-dimensional object on a surface of a material, the apparatus having at least one processing unit, the processor-controlled object forming apparatus comprising:

a height information obtaining unit obtaining height information specifying a height of the three-dimensional object on the surface of the material, wherein the three-dimensional object has (i) a design area that includes printed symbols in a symbol area, and (ii) a non-symbol protection area surrounding the symbols; and a three-dimensional object forming unit forming the three-dimensional object based on the obtained height information, wherein the height of the three-dimensional object in said protection area is higher than in said symbol area.

12. The object forming apparatus according to claim 11, wherein the height information obtaining unit obtains first height information, based on a design selected for said three-dimensional object, specifying height of the printed symbols;

the height information obtaining unit generates, based on the first height information, second height information specifying the height of the three-dimensional object in the protection area that is higher than the height of the three-dimensional object in the symbol area, and the three-dimensional object forming unit forms the three-dimensional object on the surface of the material based on the generated second height information.

13. The object forming apparatus according to claim 12, wherein the obtained first information includes height information of the protection area; and the height information obtaining unit generates the second height information from the first height information by increasing the height information of the protection area in the first height information.

14. The object forming apparatus according to claim 12, wherein the height information obtaining unit generates the second height information from the first height information by decreasing the height information of the symbol area in the first height information.

15. The object forming apparatus according to claim 12, wherein the material is a heat-expandable sheet, and the three-dimensional object forming unit forms the three-dimensional object by expanding the heat-expandable sheet based on the second height information.

16. The object forming apparatus according to claim 12, wherein the symbols are numbers or characters representing a face value of a stamp.

17. The object forming apparatus according to claim 11, wherein the obtaining of the height information of the three-dimensional object comprises generating said height information.

18. A non-transitory nonvolatile computer-readable recording medium storing a program which, when executed by a processor of a processor-controlled object forming apparatus for forming a three-dimensional object on a surface of a material, causes the processor-controlled object forming apparatus to:

obtain height information specifying a height of the three-dimensional object on the surface of the material, wherein the three-dimensional object has (i) a design area that includes printed symbols in a symbol area, and (ii) a non-symbol protection area surrounding the symbols; and form the three-dimensional object based on said obtained height information, wherein the height of the three-dimensional object in said protection area is higher than in said symbol area.

19. The non-transitory nonvolatile computer-readable recording medium according to claim 18, wherein the program further causes the processor-controlled object forming apparatus to:

obtain first height information, based on a design selected for said three-dimensional object, specifying height of the printed symbols;

generate, based on the first height information, second height information specifying the height of the three-dimensional object the protection area that is higher than the height of the three-dimensional object in the symbol area, and form the three-dimensional object on the surface of the material based on the generated second height information.

20. The non-transitory nonvolatile computer-readable recording medium according to claim 19, wherein the obtained first information includes height information of the protection area; and the generation of the second height information from the first height information comprises increasing the height information of the protection area in the first height information.

21. The non-transitory nonvolatile computer-readable recording medium according to claim 19, wherein the material is a heat-expandable sheet, and the three-dimensional object is formed by expanding the heat-expandable sheet based on the second height information.

22. The non-transitory nonvolatile computer-readable recording medium according to claim 19, wherein the generation of the second height information from the first height information comprises decreasing the height information of the symbol area in the first height information.

23. The non-transitory nonvolatile computer-readable recording medium according to claim 19, wherein the symbols are numbers or characters representing a face value of stamp.

24. The non-transitory nonvolatile computer-readable recording medium according to claim 18, wherein the obtaining of the height information of the three-dimensional object comprises generating said height information.

* * * * *